US005137435A

United States Patent [19]

Walton

[11] Patent Number: 5,137,435

[45] Date of Patent: Aug. 11, 1992

[54] COMPRESSION SPRING FLUID MOTOR

[75] Inventor: Frank Walton, Argyle, Tex.

[73] Assignee: Frank and Robyn Walton 1990 Family Trust, Lewisville, Tex.

[21] Appl. No.: 674,792

[22] Filed: Mar. 25, 1991

[51] Int. Cl.[5] ..... F04B 9/10

[52] U.S. Cl. ..... 417/403; 91/224; 91/227; 91/229; 91/347

[58] Field of Search ..... 417/401, 403, 404; 91/347, 224, 227, 229, 346; 137/99

[56] References Cited

U.S. PATENT DOCUMENTS

| | | | |
|---|---|---|---|
| Re. 29,193 | 4/1977 | Carlyle | 137/99 |
| 1,506,834 | 9/1924 | Hook . | |
| 1,674,614 | 6/1928 | Berkman . | |
| 1,859,834 | 5/1932 | May . | |
| 1,887,836 | 11/1932 | Faber . | |
| 2,044,044 | 6/1936 | Anthony . | |
| 2,262,031 | 11/1941 | Meyer . | |
| 2,658,485 | 11/1953 | Dreyer | 91/347 X |
| 2,712,427 | 7/1955 | Welborn et al. . | |
| 2,750,930 | 6/1956 | Baur et al. . | |
| 3,213,873 | 10/1965 | Cordis . | |
| 3,405,606 | 5/1972 | Scheffer . | |
| 3,665,808 | 5/1972 | Vestal . | |
| 3,680,985 | 8/1972 | Ginsberg et al. . | |
| 3,692,274 | 9/1972 | Rosen et al. . | |
| 3,753,528 | 8/1973 | Gibbs . | |
| 3,880,055 | 4/1975 | Nakamura et al. . | |
| 3,901,313 | 8/1975 | Doniguian et al. . | |
| 3,937,241 | 2/1976 | Cloup | 417/403 X |
| 4,060,351 | 11/1977 | Cloup | 417/520 |
| 4,558,715 | 12/1985 | Walton et al. | 91/347 X |
| 4,756,329 | 7/1988 | Cloup | 417/403 X |
| 4,809,731 | 3/1989 | Walton et al. | 137/99 |
| 5,002,468 | 3/1991 | Murata et al. | 417/401 |

FOREIGN PATENT DOCUMENTS

| | | |
|---|---|---|
| 595458 | 12/1947 | United Kingdom . |
| 9440 | 12/1988 | World Int. Prop. O. . |

*Primary Examiner*—Leonard E. Smith

*Attorney, Agent, or Firm*—Hubbard, Thurman, Tucker & Harris

[57] ABSTRACT

A reciprocating primary fluid driven motor has a stepped piston in a housing having a center hanging actuator rod which extends into the piston to periodically cooperate with an axially shiftable connector member in the piston which operates valves which establish the reciprocating stroke of the piston by opening and closing valve members on the larger and smaller faces of the stepped piston. A block member with compression spring drivers pivotally mounted inside the piston slides on the actuator rod during movement of the piston. The drivers are compressed in response to spaced stops on the actuator rod during continued movement of the piston until a sudden over-center movement of the block member shifts the connector to operate the valve members to cause reciprocation of the piston. Quiet operation during shifting is provided by shock absorbers. No sliding seal with the actuator rod is necessary. Provision for bleeding air from the housing chamber facilitates startup. The stepped piston is connected to a secondary fluid additive pump to inject metered amounts of secondary fluid into the primary fluid stream.

33 Claims, 5 Drawing Sheets

COMPRESSION SPRING FLUID MOTOR

BACKGROUND OF THE INVENTION

1. Field Of The Invention

The invention pertains to an improved fluid motor powered by a primary fluid stream in a pumping apparatus for injecting predetermined quantities of secondary fluid additive into a primary fluid stream.

2. Background Of The Prior Art

Several devices have been developed for injecting predetermined quantities of liquid additives into a primary liquid stream for such applications as adding medication to drinking water for livestock, treating water with additives such as halogens, or adding fertilizer concentrate to irrigation water, for example. In known devices, energy supplied to the pumping mechanism originates from the flow of the primary fluid under pressure in an enclosure containing a stepped differential piston. A mechanism with valves carried by the piston enables the fluid pressure to be applied to either face of the stepped piston, which thus describes a reciprocating motion and which forms the driving member for a metering piston interacting with a cylinder in communication with a storage vessel of the product to be injected. Such devices are found in my own U.S. Pat. Nos. 4,558,715 and 4,809,731, as well as U.S. Pat. No. 4,756,329 to Jean Cloup.

In conventional reciprocating fluid powered motors, a sliding shaft extends through the head of a differential stepped piston, usually through the center of the piston, and extends on both sides of the piston. The shaft is connected to a toggle mechanism and controls two sets of valves which alternately close fluid passages in one stepped piston face and open a flow passage or passages in the other stepped piston face. When the piston moves up or down in response to greater fluid pressure on one of the stepped faces, the upper or lower ends of the rod strike the housing causing the rod to stop moving while the piston continues to move. This causes relative sliding movement between the rod and the pressurized face of the piston requiring a seal therebetween to prevent the loss of pressure.

Conventional designs for these pump motors have a multitude of parts which are subject to stresses and wear and which decrease the ease of assembly, disassembly and maintenance. It would be desirable to have a more reliable rugged construction which the improved motor provides. In addition, the conventional toggle mechanisms are noisy, with parts assembled in such a way that it is very difficult to provide them a silencing means. It would be desirable to produce a quieter unit because pumping apparatus of this kind are frequently used in places where their noise in operation disturbs people in the surrounding area.

Air is often trapped in the upper chamber of the housing at start up and it would be desirable to provide a convenient way of bleeding the air to facilitate initiation of operation. It would also be desirable to have a way to stop the piston periodically without bypassing primary fluid around the motor.

Conventional apparatus employs extension springs having ends connected to parts which move away from the center in tension. These are disadvantageous because they are difficult to install or remove, and because the coils are tightly wound, the individual coils are difficult to process in secondary operations which could be used to make them more effective or protect them from a corrosive environment which is often present.

SUMMARY OF THE INVENTION

An improved primary fluid driven reciprocating motor for a pump apparatus may be connected for reciprocation of any conventional secondary fluid additive pump whereby the liquid additive may be metered in a predetermined manner for injection into the primary fluid stream.

The improved fluid motor is at the same time simpler and more rugged and reliable having fewer parts to wear than the conventional design, contributing to the economy of construction and long life. The inlet and outlet poppets which operate on the faces of a stepped piston in a housing are separated from each other and placed on different levels, connected to a sturdy elongated member.

Another characteristic of the improved pump motor is the absence of the necessity for a sliding seal between the piston and the sturdy elongated member or an axially arranged center-hanging actuator rod which pass through the head end of the piston.

Another characteristic of the improved motor is the fixation of a center-hanging actuator rod from the top of the housing having the stepped piston, which remains stationary while the piston reciprocates. A characteristic advantage of the improved pump motor is the much quieter operation, especially when the stepped piston changes direction. The shifting mechanism is easily provided with shock absorbing components which absorb shock and deaden sound during cooperation of the actuator rod and an operator means which operate opposed sets of valves to control application of fluid pressure to the piston faces. The center-hanging actuator rod has a means for conveniently bleeding air from the housing chamber during start up.

Compression springs are used for both the main shifting mechanism and a positioning means which tends to hold the valve sets in opposite alternate positions. Compression springs are easier to install and remove and are more conveniently and economically subject to secondary treatments, such as shot peening, coating or painting because the individual wire coils are exposed to any such secondary process. The use of compression springs instead of extension springs provides the opportunity of processing to obtain stress relief and greater resistance to corrosive environment.

A modification to the pump motor permits stopping the reciprocation of the piston by changing the center-hanging actuator rod's position along an axial path. This causes the piston to partially open the opposed valves allowing primary fluid to pass through without operating the piston. This avoids the necessity for having a bypass line and set of valves in the primary fluid supply line in order to be able to deliver primary fluid at the outlet of the system (i.e., sprinkler heads for example) without also delivering secondary fluid (i.e., fertilizer for example) when it is not needed.

The piston is economically molded as a strong main part with a separately attachable large diameter part which facilitates quick installation and removal of an internally located valve collar mounted on a shiftable columnar connector member. Finally, the pump motor could be operated in a different mode by connecting the pressurized fluid to the outlet side of the housing, preferably with the valve means reversed to move away from the valve seats in the direction of the pressure flow.

These and more characteristics of the compression spring fluid motor for reciprocating a fluid injection pump are obtained by providing a motor housing having axially arranged internal cylinder walls for slidingly engaging the different diameters of a stepped piston having a large diameter face and a smaller diameter face. The stepped piston body being slidingly mounted in the housing in the axially arranged internal cylinder walls and having at least one fluid opening in each face communicating through the piston body. The housing has a inlet passage for conducting primary fluid under pressure from an inlet to one of the stepped faces of the piston and an outlet passage for conducting primary fluid under pressure from the other of the stepped faces of the piston, to an outlet in the housing.

A center-hanging actuator rod means periodically cooperates with an operator means to shift the elongated connector member alternately relative to the stepped piston, overcoming the biasing force of the positioning means. The shiftable connector member by operation of the valve means therewith, establishes the reciprocating stroke of the piston by closing one set of valve means in one stepped face of the piston while opening the other set of valve means in the opposite other stepped piston face.

DETAILED DESCRIPTION OF THE PREFERRED EMBODIMENT

Figure 1A:
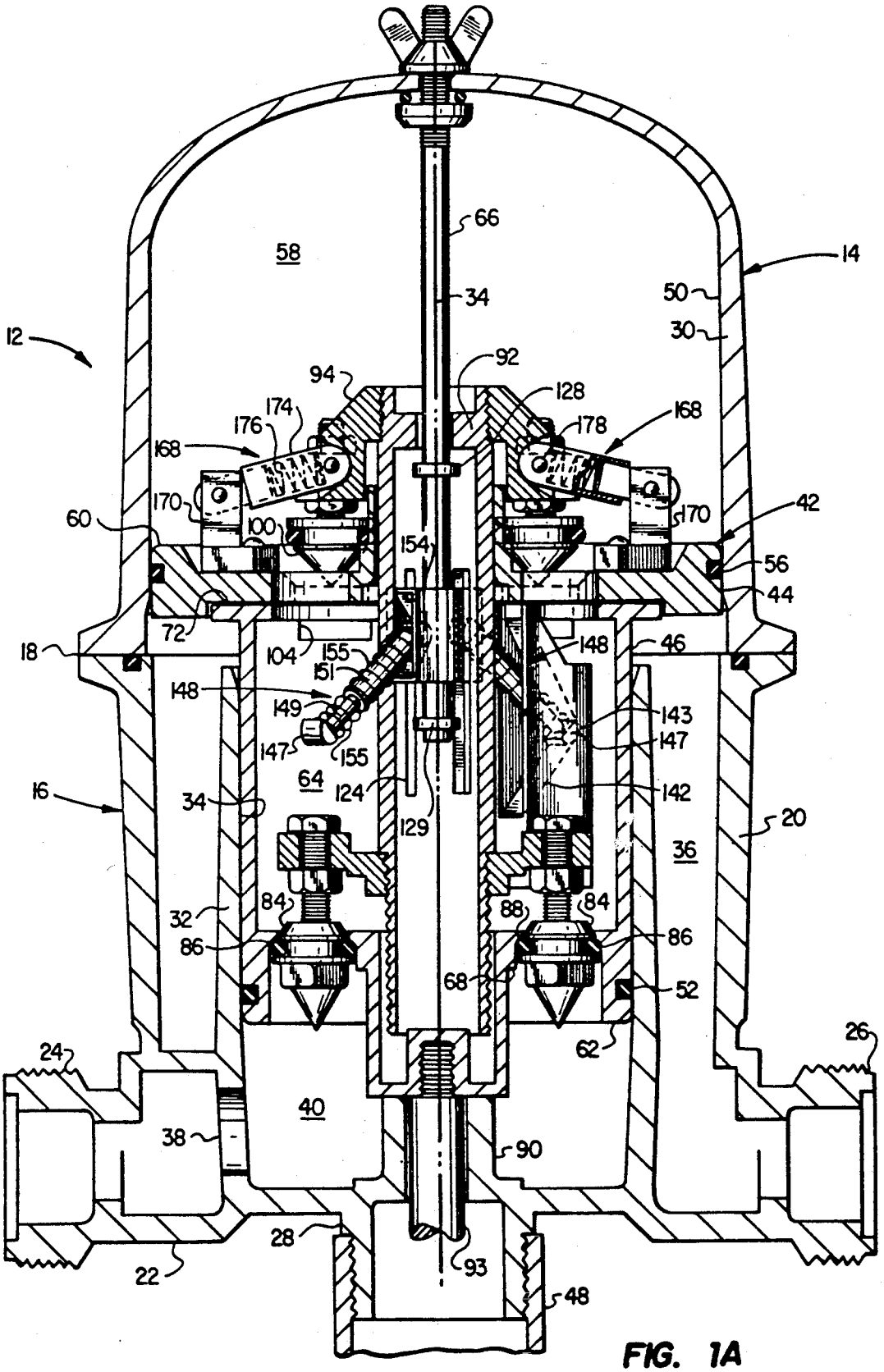
FIG. 1A is a longitudinal central section view of the fluid pump motor piston at the bottom of its stroke.

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and preciseness.

Figure 1B:
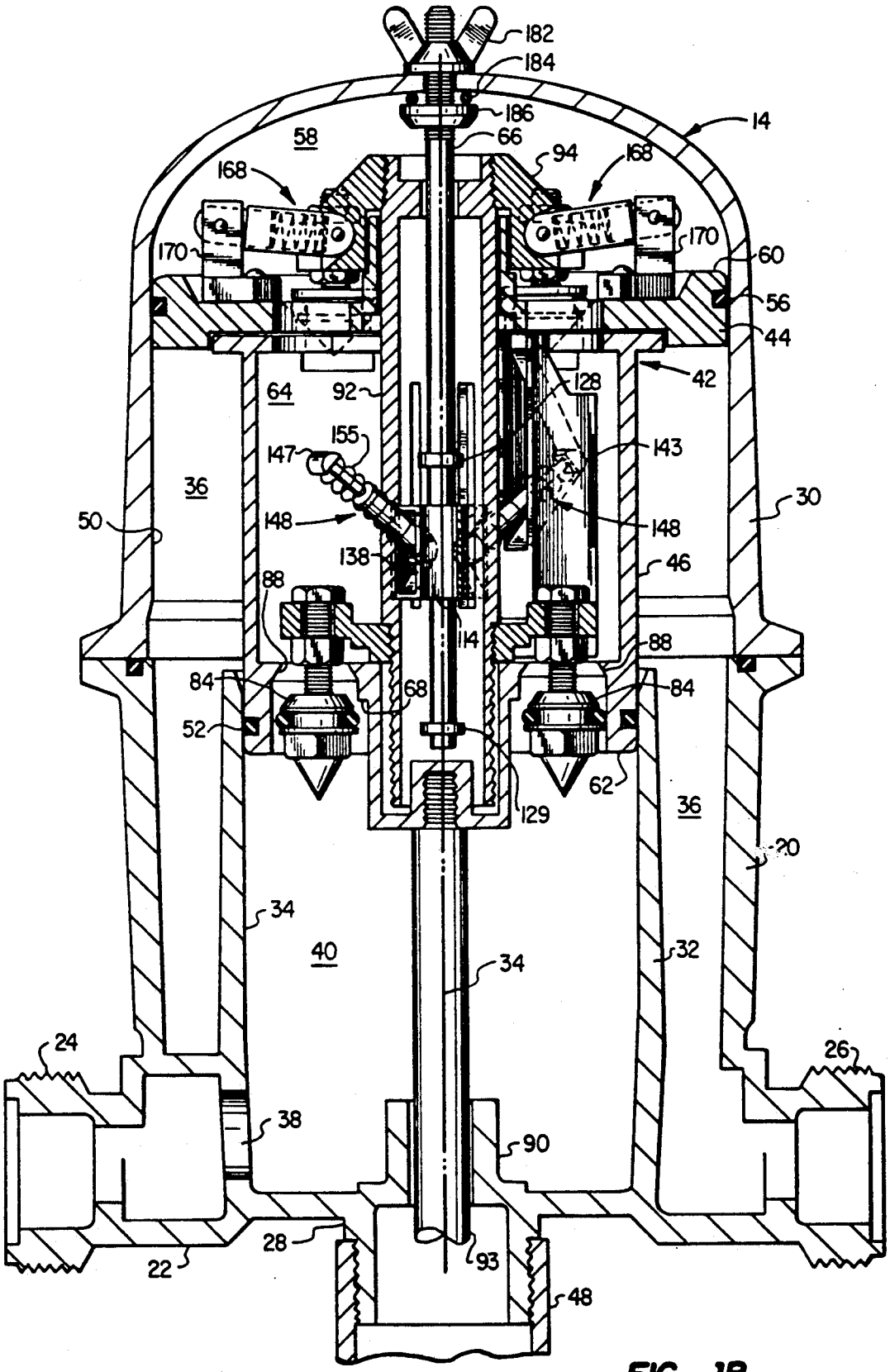
FIG. 1B is a similar cross-section to that of FIG. 1A with the pump piston at the top of its stroke.

Referring to FIGS. 1A and 1B, the improved compression spring fluid motor is generally referred to by reference numeral 10. A cylindrical housing designated generally as 12 has a domed upper portion 14 and a lower portion 16 forming a substantially cylindrical enclosure, closed in a leak proof manner at a medial joint plane 18 which may include an annular seal and a clamping ring to hold the two portions of the housing together. The lower part 16 has a lower cylindrical wall 20 closed by a bottom wall 22 having a threaded inlet 24 and threaded outlet 26. Pressurized primary fluid is supplied to the inlet 24 and ultimately exits through outlet 26 of the housing. Bottom wall 22 has a threaded boss 28 extending downwardly for sealed connection with an injection pump cylinder 48 shown in FIG. 2. Upper part 14 has a cylindrical wall 30. Extending from lower wall 22 is a smaller diameter axially arranged inner cylindrical wall 32 concentric with the central axis 34 and the larger diameter wall 30.

The cylindrical wall 32 stands concentrically with wall 20, being of smaller diameter, and having cylindrical bore 34. The annular space 36 defined by the walls 20, 32 is in communication with an outlet passage leading to the outlet 26. An opening 38 in the lower portion of wall 32 is in fluid communication between the inlet 24 and is part of an inlet passage leading to a first variable chamber 40. Alternately, a different mode of operation could be provided by attaching the source of primary fluid to the outlet 26 and the inlet 24 becomes the outlet. This would have the advantage that the flow of primary fluid would come down through the piston body so that secondary fluid entering the bottom of the housing would not pass through the pump mechanism. It would be mixed below the piston to pass with the fluid to the exit.

In the preferred mode the opening 38 is in the inlet passage. A stepped piston generally designated 42, having a large-diameter upper part 44 and a smaller diameter lower body part 46, is slidingly mounted for reciprocation in the housing with the smaller part sealingly engaging the bore 34 of wall 32 and the larger diameter part sealingly engaging the bore 50 of upper housing 14. Suitable "O" ring seals 52, 56 are installed respectively in a smaller diameter and larger diameter portions of the stepped piston, mounted in peripheral grooves.

The large diameter part 44 of the stepped piston 42 has an upper face 60 defining a second variable chamber 58 in the upper housing 14. Similarly, the smaller diameter lower part 46 has a face 62 which defines a variable chamber 40. It is to be understood that the opposite faces 60, 62 are somewhat irregular because of various recesses, valve seats and openings provided therein. Annular space 36 might also be referred to as a third variable chamber in that it is separated from the other chambers by the stepped piston. The stepped piston reciprocates to occupy a variety of positions which is what varies the chamber volumes. In the preferred mode, the chamber 40 is in permanent communication with the inlet 24 for the primary fluid, the chamber 36 is in permanent communication with the fluid outlet 26, while the chamber 40 is in selective communication through the interior 64 of the piston with the chamber 58, the chamber 58 also being in selective communication with the chamber 36. Chamber 36 is extended by the exterior side of the smaller diameter part of the piston. A center hanging actuator rod is fixedly but removedly attached to the upper portion of the housing on the central axis 34, extending axially centrally into the piston. The actuator means is cooperable with an operator means for shifting operatively connected valve means carried by the stepped piston and shiftable for establishing a stroke cycle of the piston by alternately closing one face of the piston and at the same time opening the other of the piston faces to pressurized fluid.

Figure 2:
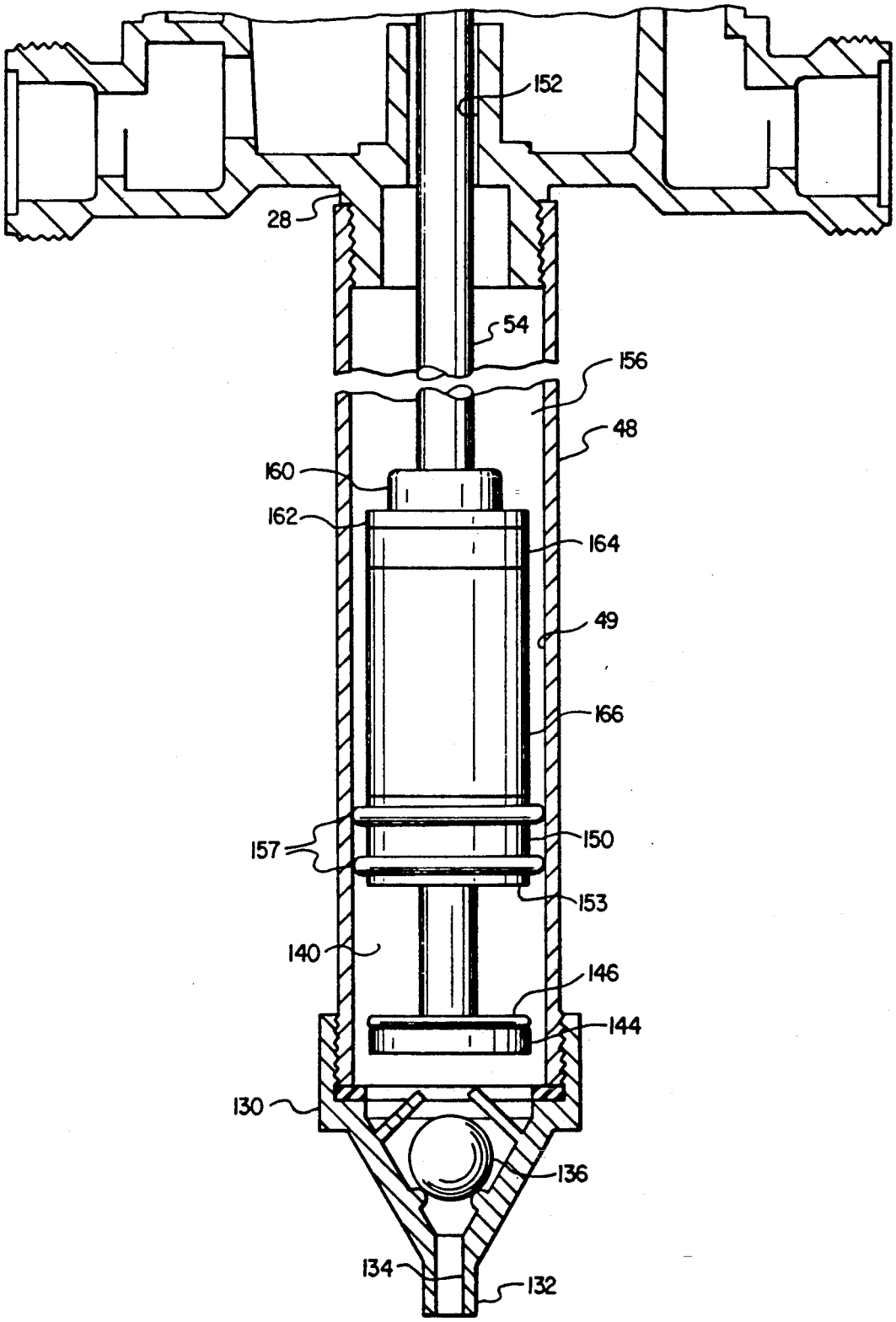
FIG. 2 is a partial cross-section view of a reciprocable pump attached to the housing of FIGS. 1A and 1B.
Figure 3:
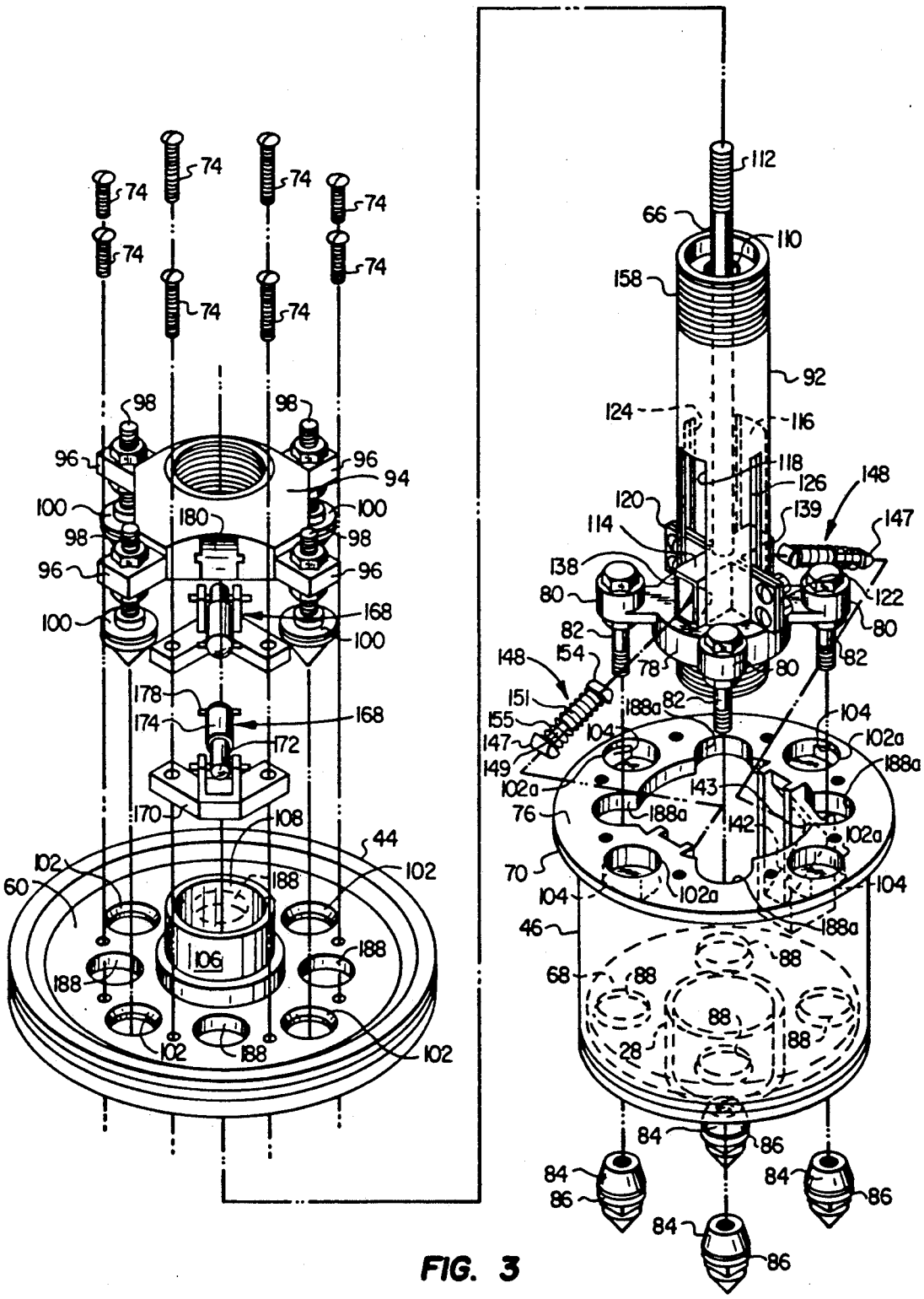
FIG. 3 is an exploded perspective view of the stepped piston, the operator means and actuator rod which shifts the columnar connector member and valve means.

FIG. 3 is an exploded perspective view of the operating components of the compression spring fluid motor 10. The lower part of the piston is molded as a single body having the smaller diameter cylindrical wall 46 connected to a base wall 68 and an upper flange 70. Extending downwardly from the base wall 68 is the boss 28 which is threaded to receive the pump shown in FIG. 2. The flanged end 70 forms part of the head end of the piston together with the large diameter part 44, which has a circular shaped recessed portion 72 better seen in FIG. 1A. Recessed portion 72 fits on top of the flange 70 where it is held by fasteners 74 after the internal shifting mechanism is installed. Together the large diameter part 44 and the upper flange part 70 of piston 46 form the large diameter piston head. Flange 70 also forms the upper face 76 of the piston body. It has a shaped central opening for receiving an operatively connected valve means which is carried by the stepped piston in a manner to be explained, and is shiftable for establishing the stroke cycle of the piston by alternately closing one face of the piston and at the same time opening the other of the piston faces to pressurized fluid.

The opening in face 76 receives a spider like collar member 78 with arms carrying one set of valve means. The collar 78 has arms 80 holding fasteners 82 having valves 84 threadedly attached. Valves 84 have cone-shaped portions for receiving "O" ring type seal 86. This is also seen in FIG. 1A where two of the four valves are seen engaging two of the four seats 88 in base wall 68 which is otherwise completely enclosed with respect to the wall 46 of the piston. Not shown in FIG. 3 is an upwardly extending boss 90 through which a rod 93 reciprocates which operates the pump in cylinder 48 below the housing.

The lower collar member is threadedly connected to a columnar connector member in a form of a hollow cylinder 92. Connector member 92 operatively connects the collar member 78 at the lower end holding a second set of valve members. A first set of valve members are attached to opposite threadedly connected collar member 94 on the upper end of connector member 92. Upper collar member 94 has spider arms 96 having fasteners 98 comprising a threaded bolt and opposing nuts which secure the fasteners 98 to the arms 96. The lower end of the fasteners 98 having cone shaped valve members 100 threadedly attached. Valve members 100 are in line with openings 102 in the recessed portion of the upper face 60 of the large diameter part 44 of the stepped piston. When large diameter part 44 is assembled on top of flange 70 of the piston body, these holes 102 are continued as blind openings 102*a* in the upper flange 70 of the piston body. Openings 102 match with openings 102*a*, but openings 102*a* do not extend all the way through the flange 70 into the space 64 of the piston body. However, openings 102*a* do extend all the way through the flange 70. Peripheral openings 104 open outwardly below flange 70 for the flow of fluid in assembly, between the chamber 58 and the chamber 36.

To assemble the operating mechanism, the lower collar 78 is threaded to connector member 92 which is inserted in the piston body with the fasteners 82 extending through the opening 88 whereupon the valve members 84 are threadedly connected to seal openings 88. The large diameter portion 44 has an axially central upwardly extending boss 106 having opening 108 which is designed to loosely fit over the outer diameter of connector member 92.

Central hanging actuator rod 66 is axially installed through an unsealed opening 110 at the upper end of connector member 92. It has a threaded end 112. Actuator rod 66 has a sliding block member 114 which extends through opposed elongated slots 116 and 118 in the side wall of the connector member. Block 114 is bifercated by 90 degree angled slide arms 120, 122. The ends of arms 120, 122 extend through companion longitudinally extending narrow slots 124, 126 oppositely arranged and at 90 degrees to slots 116, 118. Block 114 is thus seen to be made in two halves which are installed and then joined together by connecting at the ends 120, 122 of the bifercating flanges of the slide arms. This facilitation is helpful because as seen in FIG. 1A, rod 66 fixedly has a donut shaped upper stop 128 and a spaced apart lower stop 129 which activate the operating mechanism to be described. However, block 114 could consist only of opposed end portions 138, 139 and the main body therebetween without the bifercating arm portions 120, 122 and without the extra slots at right angles to the other slots, slots 124, 126. This would be appropriate if the lower stop were installed after the block member is fitted onto the actuator rod.

The body of the piston has two opposed recessed portions 142 molded in which have a hinge point 143 at the back of the recess for receiving one end 147 of compression spring drivers 148. Ends 147 are rounded and have a shaft 149 which slidingly fits a sleeve 151 having at the opposite end another pivoting head 154. A compression spring 155 slides over the sleeve 151 and rests against the heads 147, 154. The opposite ends 138, 139 of the sliding block are recessed back towards the center to pivotingly accept the heads 154 of the opposed drivers 148. Thus, one end of the drivers 148 is pivoted in the recessed interior of the piston body and the other end is pivoted in the ends of the sliding blocks.

Opposed drivers 148 are placed in the pivot points between the piston body and the sliding block as the connector member 92 and collar 78 are installed into the central interior of the piston body. Next the opening 108 in the large end of the piston is placed over the end of the connector member 92 on the flange 76 and fastened by the fasteners 74 in cooperating threaded openings of the flange 70. Then the upper collar member 94 is threadedly attached to the threaded upper end 158 of connector member 92 and adjusted to align with the openings 102.

Opposed positioning means 168 each have angled brackets 170 with openings for fastening by fasteners 74 to cooperating threaded openings in the face 60 of the large diameter portion 44. A shaft 172 of positioners 168 is pivotedly pinned to a upstanding part of the angled brackets 170. The shaft is slidingly inserted into a sleeve 174. Inside sleeve 174 a spring 176 is hidden. A pivot pin 178 in the inner end of sleeve 174 is inserted into a slotted recess 180 on directly opposite sides of collar 94. It should be noted that the position of the brackets and positioner members are correct in FIG. 3 but they are both rotated 90 degrees in FIGS. 1A and 1B so they can be seen.

Thus, positioners 168 are pivotedly mounted at both ends, and when assembled create an over-center action which tends to hold the collar member 94 in one of two alternate axially shifted positions. It can be seen that the collar members, connector member and the two sets of opposed valve members are shiftable together to close the openings in one stepped piston face while opening the openings in the opposite other stepped piston face to effectively control the stroke cycle of the stepped piston.

Referring now to FIG. 2 a secondary fluid injection pump is shown as disclosed in my U.S. Pat. No. 4,558,715, the description of which is incorporated by reference herein. Briefly, a description of the parts will be given using the same reference numerals as were used in the above stated previous patent.

An injection pump cylinder 48 is attached to the bottom of the housing closed at its lower end by a removable cap 130. Cap 130 includes a fitting 132 forming a liquid additive inlet passage 134. It has a check valve 136 to prevent flow of fluid out of interior chamber 140 through passage 134.

Lower transverse flange 144 at the end of piston rod 54 supports circumferential seal 146. Pump cylinder 48 has an internal bore 49 slidingly supporting piston 150. Piston 150 is slidably journaled on the rod 54 and includes a plurality of longitudinal passages formed therein and communicating a chamber 140 below the piston with a chamber 156 above the piston assembly in the upper part of cylinder 48. Face 153 of piston 150 is engagable with seal ring 146 to close off fluid communication between chambers 140 and 156. The piston 150 has suitable seals 157. The rod 54 may be dividable into an upper and a lower rod removably connected with collar 160. Stacked above piston 150 are a plurality of additive pump displacement control washers 162,164, and 166 which are of smaller diameter than bore 49 and are loosely retained on piston rod 54 to permit free flow of additive fluid therearound.

When the piston 150 goes down, fluid is forced through the longitudinal passages from chamber 140 to chamber 156, and enters the housing containing the primary fluid through an opening 152 in the bottom wall of the housing. When the piston rod is moved upwardly the flange 144 moves upwardly to sealingly engage the piston 150 with the seal 146. Further upward movement draws additional additive fluid to the lower chamber 140 while causing fluid above the seals 157 to be forced into the housing, in a predetermined quantity, depending upon the number of washers and pump stroke cycle which is determined by reciprocation of the motor in the housing above. Operation is as described in my U.S. Pat. No. 4,558,715.

In operation, the stepped piston has an operating cycle which is represented by the downward most position of the stroke in FIG. 1A and the upward most portion of the stroke illustrated in FIG. 1B. The stroke is determined by the shifting of operatively connected valve means carried by the stepped piston means. The operatively connected valve means comprise a first set of valve means mounted on the upper collar member 94 removably connected to the upper end portion 158 of the connector member, which is shiftable to open and close openings in the large diameter face of the stepped piston. A second set of valve means, also removably connected to the connector member 92, is attached to the lower collar member 78 for opening and closing openings in the smaller face of the stepped piston. The connector member is shiftable to close one of said sets of valve means while at the same time opening the other set of said valve means to control the flow of pressurized fluid to the respective opposite small and large diameter stepped piston faces.

The positioner means 168, oppositely arranged on the upper large diameter face of the piston are mounted between the brackets 170 and the collar 94 in a degree of compression of the springs which operate in an over-center action, wherein they tend to hold the valve means alternately in an open position of the valve means in one piston face and a closed position of the valve means in the other piston face. As shown in FIG. 1A they are angled upwardly in one position of the piston or in FIG. 1B angled downwardly in another position of the piston, from a center position which would occur when they were positioned horizontally. The connector member is a strong hollow tubular member which causes the valve means to move in unison because the collars are fixedly attached by threaded connections. The connector member has a hollow center into which the actuator rod means passes through the upper end of the connector member, the actuator rod means including the spaced apart stops 128, 129.

In the position of FIG. 1A the pressurized fluid passes through opening 38 into first variable chamber 40. Since the valve means have closed the openings in the small diameter face, the piston is urged upwardly while the upper valve means are open allowing fluid in the upper chamber 58 to pass through the openings 102 into blind openings **102*a* and out of peripheral openings 104 in the top of the piston. The fluid enters chamber 36** below the large diameter face.

The connector member and collar members are carried upwardly with the stepped piston and do not move during a portion of the upward travel. The sliding block member 114 in the center of the connector member slides on the actuator rod 66 until it comes in contact with the upper stop 128 which causes it to stop moving upwardly while the piston continues to move upwardly. This action loads the springs on the drivers 148 causing the angled drivers to pivot downwardly towards the horizontal centered position, because the ends 147 are pivoted in the interior of the stepped piston body. The drivers continue to compress as the piston body moves upwardly while the sliding block is held by the stop 128. As this movement continues the drivers reach a horizontal position with the springs compressed, and on further movement of the stepped piston an over-center action is initiated which suddenly causes the sliding block 114 to move to the bottom of the opposed slots 116, 118 near the top of the lower collar 78 where they impart force to the connector member. The imparted force shifts the connector member to the position of FIG. 1B, overcoming the upward component of the force provided by the positioner means 168, because the drivers are more powerful and store more energy than the springs in the positioner means 168.

After this shift the valve members on the smaller face of the piston are open and the upper valve members are closed. Fluid from the primary inlet 24 is free to bypass valve members 84 and flow from chamber 40 to the interior 64 of the piston body and out through the openings 188 in the large diameter part of the piston assembly. Openings 188 are open to the interior chamber 64 of the piston body through corresponding openings **188*a* in flange 70 of the piston body. At the same time, the upper set of valve members close the openings 102 leading to the blind openings 102*a* and their peripheral opening 104. Consequently, pressurized fluid is introduced to the upper face of the large diameter part and is equalized in pressure with respect to chambers 40, 64 and 58, except perhaps for some minor fluid flow losses. Since chamber 36 is connected to the outlet passage and outlet 26, it is the only chamber at a significantly lower pressure, below the large diameter part of the stepped piston. It is isolated from the interior 64 of the piston body by the wall of the smaller diameter part 46. Pressure above the piston causes the stepped piston to change direction and reciprocate in the opposite direction forcing the fluid confined in chamber 36** below the large part of the stepped piston to move through the outlet passage into the outlet area.

The stepped piston moves downwardly in this fashion towards the bottom of the housing until the bottom of the sliding block 114 encounters the lower stop 129 on the actuator rod 66 where it remains stationary while the stepped piston continues to move downwardly. The drivers are again compressed and the inwardly most head ends 154, which are pivoted in the recesses of the opposite ends of the sliding block, are pivoted but remain at the same elevation while the opposite head ends of the drivers continue to move down towards the horizontal center position because the they are pivoted to recesses in the piston body.

Shortly after they have reached the central position where they are horizontal, the energy stored in the drivers is released. The sliding block slides upward on the actuator rod 66 striking the upper ends of the opposed slots 116, 118 where it operates to shift the connector member, overcomes the positioner means forces and causes the first set of valve members on the large diameter face to open while the second set of valve members on the smaller diameter face of the stepped piston are again closed. It can be seen that this process repeats as long as pressurized fluid is supplied to the inlet 24 and allowed to be removed through the exit 26. The sliding block and drivers constitute an operator means operated by the piston and the actuator rod and cooperating therewith for alternately shifting the operatively connected valve means at the top and bottom of the operating cycle of the stepped piston whereby pressurized primary fluid alternately operates on the large and smaller faces of the stepped piston to reciprocate the piston. The positioning means simply bias the operatively connected valve means to alternate closed positions of one of the piston faces and an open position of the other of the piston faces. The positioning means is shiftable with the valve means by the operator means.

This unique construction provides plenty of room to install shock absorbing members which significantly reduce noise of operation. It is contemplated that the sliding block member can be made of rubber and plastic with the rubber portion coming in contact with the tops and bottoms of the elongated slots in the hard plastic connector member to reduce shock and noise. Alternately it is easy to put rubber "washers" on the shaft 66 above and below the sliding block with extensions of the rubber passing through the slots. Then if the block is made of hard plastic or even light alloy metal, the rubber "washers" absorb the shock when the shift suddenly occurs. The sound is deadened.

Of particular significance is the absence of any seal required where the connector member passes through the head end of the piston as indicated in FIGS. 1A and 1B. There is no need for a sliding seal at that place because the pressure internally of the piston body and in the chamber above the large diameter face is substantially the same throughout the entire cycle. Differential pressure only exists between the chambers 58 and 36 which are separated by the seal on the large diameter piston face which is required in any event. This reduces the tendency of reciprocating pump motors of this type from failing because of a seal failure which permits pressurized fluid to bypass into a relatively unpressurized part of the device. This means that it does not matter if wear occurs because of shifting of the operator means and connector member, since a leak at the junction with the large head end of the piston would be of no consequence.

An additional advantage provided by the actuator rod which is fixed to the top of the housing by a wing nut 182 and sealed against leakage by a bushing 186 and a seal 184. In a new installation, or after liquid has been allowed to drain from the outlet side, a pump motor can include air in the chamber 58 which interferes with the initiation of operation of the pump motor 10. A bleeder means is provided by slightly loosening the wing nut until the pressurized fluid drives the undesirable air from chamber 58, whereupon the wing nut is again tightened to restablish the seal. The bleeder opening and a bleeder valve can be at another place in the dome apart from the rod.

In an alternate mode referred to earlier, the inlet and outlets are reversed with pressurized primary fluid entering through outlet 26. With the upper set of valves closed and the lower set of valves open, the fluid is blocked by the wall of the small diameter portion of the piston and the underside of the large diameter head. The piston rises and fluid in chamber 58 escapes through the openings **188, 188*a* to pass through the space 64 in the piston body, the chamber 40 and thence through opening 38** to the outlet.

When the operating mechanism shifts at the top of the stroke the top set of valve members are opened and the bottom set closed. Now pressurized fluid from 26 (the reversed inlet) passes into chamber 58 through the peripheral openings 104 and thence into the interior 64 of the piston body through openings **88, 188*a* to pressurize the small face of the piston and force it down. Fluid trapped in the space 40 below the face of the piston exits through opening 38 to the (now reversed) outlet 24**. Reciprocation occurs as before.

Figure 4:
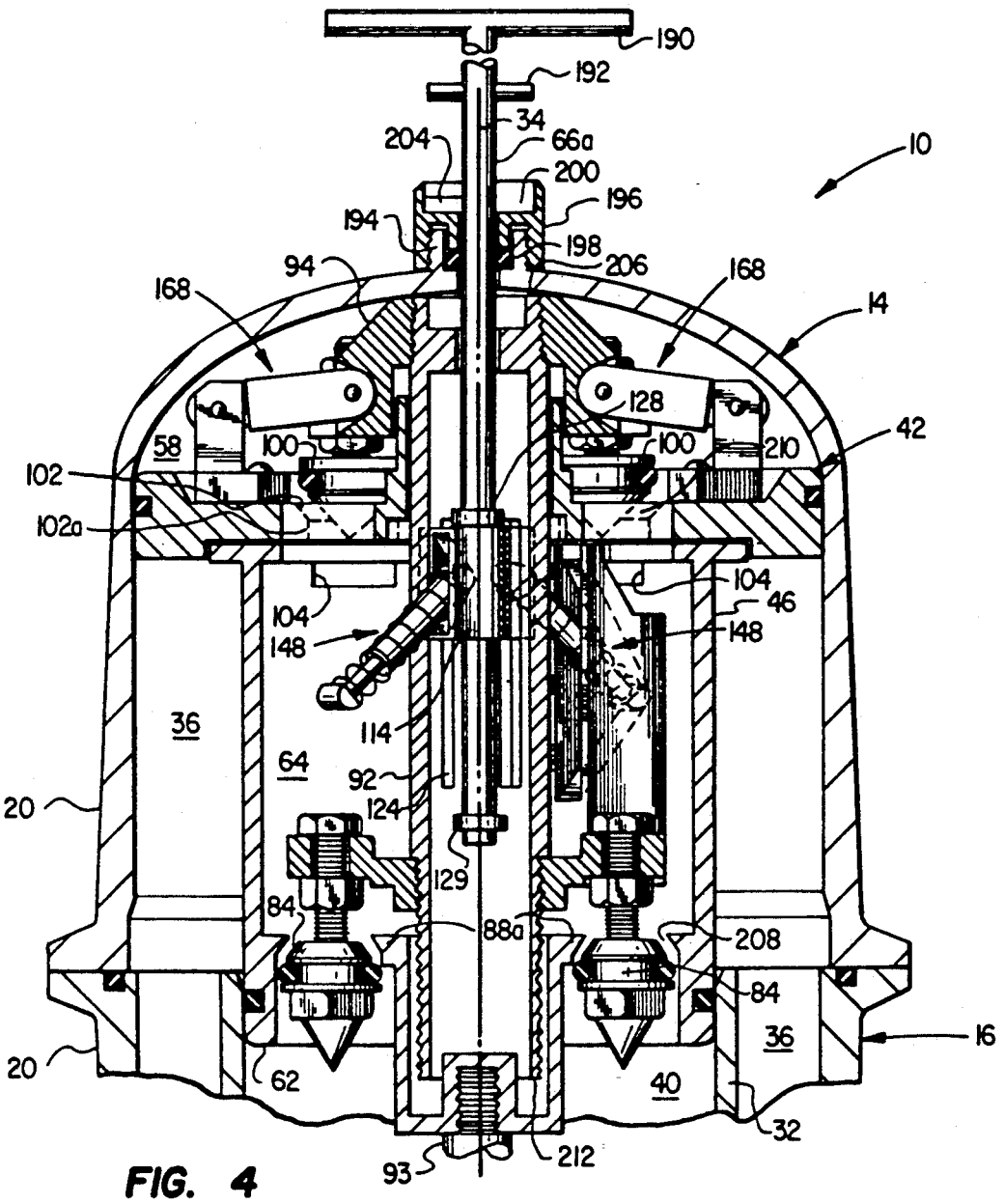
FIG. 4 is a partial longitudinal central section view of a control modification which allows primary fluid to pass through the unit with the piston stopped.
Figure 5:
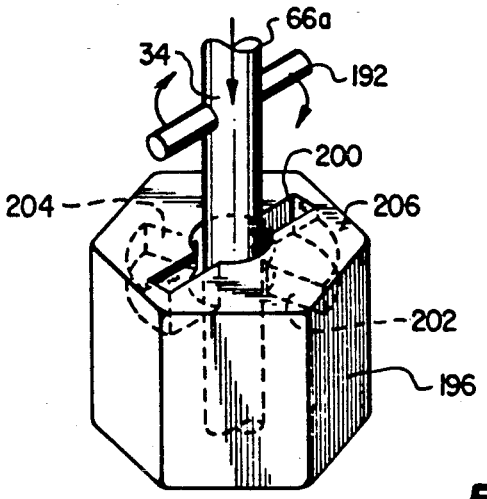
FIG. 5 is an enlarged perspective view of a special closure at the top of the housing which captures a pin in the actuator rod to secure it for normal operation of the unit.

A modification of the compression spring fluid motor 10 is seen in FIGS. 4 and 5. The stepped piston 42 seen in FIG. 4 is identical to the assembly shown in FIGS. 1A and 1B. A modified actuator rod **66*a* is provided in place of actuator rod means 66 shown in the other Figures. Modified actuator 66*a* is the same as rod 66 having the same spaced apart stops 128, 129 which cooperate with the same sliding block member 114. Modified rod 66*a* has a handle portion 190 at its upper end and a fixed pin shaped key 192 below the handle. The housing is modified to have a threaded boss 194 centrally extending upwardly from the upper portion 14 of the housing to which is connected. A connecting means 196 threadedly engages the boss 194 and has a portion which compresses a seal 198 around the actuator rod 66*a***.

As better seen in FIG. 5, connector member 196 is in the form of a nut having a slotted opening 200, having undercut recessed portions 202 and 204. The undercuts lie below the surface 206 of connecting means 196. In FIG. 5, it is easily seen that when modified rod **66*a* is pushed downwardly, pin 192, which is fixedly attached through an opening in the rod 66*a*, enters the slot 200, and upon rotation of the handle 190 in the clockwise direction of the arrows, the pin is secured in the undercut recessed portions and thus fixed to the housing. The undercut portions of the connector 196 may also include frictional holding means so that the rod 66*a* will be securely held with a good turn on the handle 190. Conversely, when the handle is rotated to align the pin 192 with the slot 200, the actuator rod 66*a* is released and is slidable along its longitudinal axis as indicated by the arrow along the axis 34**.

When the pin 192 is inserted in the slot and turned under the over-hanging ledges of recesses 204, 206, the portion of the rod extending into the housing through an opening at the top center of the housing is positioned exactly as in FIGS. 1A and 1B. Similarly, the stops 128, 129 are thus positioned in exactly the same position for operation. When the handle is turned to release the pin 192 from the slot 200, the actuator rod 66a is free to move and no longer cooperates with the operator mechanism, including the compression spring drivers and the sliding block 114, slidingly mounted thereon.

The operation with the actuator rod 66a in the unfixed freely slidable position is best understood by beginning with the position shown in FIG. 1A. With pressure applied to the inlet 24 and the valve means 84 closing bottom face 62, the piston, connector member 92, block 114, drivers 148, the collars and valve members, and positioning means 168 are all carried upwardly by the piston. Since the rod 66a is freed from the connector 196 its weight causes it to rest with the pin 192 on top of the connector, or perhaps spaced therefrom because of slight friction with the seal 198. In any event, as the assembly moves upward with the stepped piston, the upper portion of the block 114 carries collar 128. Since actuator rod 66a is no longer fixed to the housing, it is simply carried along upwardly as the piston continues to travel in response to the pressurized fluid in the space 40. There may be some slight change in the position of the sliding block 114 which slightly compresses the springs on the compression drivers 148 because of the weight of the rod 66a, but otherwise everything remains the same as the piston travels upward.

Since there is nothing to stop the piston from continuing to travel upward, it travels upward until the highest contact point on the upper collar 94 and the upper end 206 of the connector strike the underside of the upper part of housing 14. Now as the piston continues to move a small distance further upwardly, there is a partial shifting of the connector member to which the upper and lower valves 100, 84 are fixedly attached, thus cracking both sets of valve members. When this occurs, a gap 208 is created between the lower valve members 84 and the pressure face 62 of the piston at the annular valve seat 88a. The pressurized primary fluid then flows from the chamber 40 through the gap 208 into the chamber 64 and out through a similar gap 210 between the upper valve members 100 and the valve seats of the opening 102, 102a and out through openings 104 where the fluid can enter the chamber 36 and thus reach the outlet 26. Because both sets of valves are cracked, the flow goes through the inlet and the piston into the annular chamber 36 and thence to the outlet 26. There is a flow passage created by the partial cracking of both sets of valves which allows the primary fluid to bypass through the stepped piston without causing any further reciprocation. The piston comes to a dead stop. (A similar result could be created to cause the piston to stop instead at the opposite end of the stroke if the valves and the valve seats were reversed and there was some means to partially shift the connector member, such as a sliding pin in the housing passing through an opening in the bottom of the piston to strike the opposite end 212 of the connector member 92.)

When it is desired to reinitiate operation of the piston motor, the handle 190 is grasped and pushed downwardly with the piston in the position of FIG. 4. The collar 128 catches the upper portion of the sliding block 114 and as the rod 66a is continued to be slid downwardly, the compression spring drivers are compressed until they reach an over-center condition which causes them to flip over into the orientation of FIG. 1B which closes the top valve members and opens the bottom valve members fully. Now the pressurized primary fluid reaches space 58 where it encounters a closed pressure face of the large diameter stepped piston which starts the piston moving downwardly again. Simultaneously, handle 190 is further depressed to lock pin 192 in connecting means 196 to put the actuator rod 66a back into its fixed position. Now the piston will continue to reciprocate in response to pressurized fluid as before described.

Consequently, the modification makes it possible to selectively stop the operation of the piston while permitting the pressurized primary fluid to continue through the system on its way to a place where it is used. Since the piston is stopped, the injector pump does not reciprocate to inject secondary fluid into the primary fluid stream and a pure primary fluid stream is directed downstream. The piston can be started and stopped at will according to the position of the actuator rod, as for example, to cease adding fertilizer solution to a sprinkler system for a period of time until more fertilizer solution is needed. It is expected that the design of the unit as shown in FIGS. 1A and 1B will be essentially the same although it may be desirable to shorten the valve seats 88a to make sure that the gap 208 is created and to make sure that the wall 32 is high enough to maintain contact with the seal of the smaller diameter piston wall 46.

The beauty of the modification is that it entirely eliminates the need to create a bypass path for the primary fluid around the pump motor so that primary fluid can be valved off and bypassed to reach its remote destiny without operating the pump motor when it is not needed. The expense of the bypass is avoided as well as space problems that are sometimes encountered in tight places. It has advantages over shutting off the supply of secondary fluid or disconnecting the injection pump from the piston in that the piston does not continue to operate creating unnecessary wear and maintenance problems.

Although a preferred embodiment of the invention has been described herein in detail those skilled in the art will recognize that various substitutions and modifications may be made without departing from the scope and spirit of the invention as recited in the appended claims.

I claim:

1. A compression spring fluid motor for reciprocating a fluid injection pump to inject predetermined quantities of secondary fluid into a primary fluid stream, comprising:

a housing having axially arranged internal cylinder walls for slidingly engaging the different diameters of a stepped piston having a large diameter face and a smaller diameter face;

a stepped piston body in the housing having opposed large and smaller diameter step faces with at least one fluid opening in each face communicating through the piston body;

an inlet passage in said housing for conducting primary fluid under pressure from an inlet to one of the step faces of the piston;

an outlet passage in said housing for conducting primary fluid under pressure from the other one of the step faces of the piston to an outlet in the housing;

a shiftable connector member carried coaxially by the stepped piston;

a center-hanging actuator rod means fixed to the housing and disposed axially within the connector member;

opposed valve means supported by the connector member for closing said at least one fluid opening in one face of the stepped piston while opening said at least one fluid opening in the other said face;

positioning means for alternately biasing the connector member to a closing position of one of said valve means in one stepped piston face while opening the other said valve means in the opposed piston face; and over center operator means cooperating with the actuator rod means to periodically move the connector member alternately relative to the stepped piston to overcome the biasing force of the positioning means and by operation of the valve means establish the reciprocating stroke of the piston.

2. A compression spring fluid motor for reciprocating a fluid injection pump to inject predetermined doses of secondary fluid into a primary fluid stream, in operative combination comprising:

housing means having primary fluid inlet and outlet;

stepped piston means having a large face and a smaller face, mounted for reciprocation in said housing and separating the interior into at least first and second variable chambers;

operatively connected valve means carried by said stepped piston means, being shiftable for establishing a stroke cycle of said piston by alternately closing one face of the piston and at the same time opening the other of said piston faces to pressurized fluid;

an actuator rod means mounted to the housing in an alternate fixed or an unfixed position, extending axially centrally into the piston, and in the fixed position, the actuator rod being cooperable with an operator means for shifting said operatively connected valve means, and being free to move axially in the unfixed position;

operator means operated by the piston cooperating with said actuator rod means when it is in said fixed position for alternately shifting said operatively connected valve means at the top and bottom of the operating cycle of the stepped piston whereby pressurized primary fluid alternately operates on the large and smaller faces of the stepped piston to reciprocate said piston when pressurized fluid is supplied to the inlet of the motor housing;

wherein the cooperation of the actuator rod with the operator means to shift said valve means is discontinued when the actuator rod is in said unfixed position thereby allowing the piston to come to rest in a stopped position.

3. A compression spring fluid motor for reciprocating a fluid injection pump to inject predetermined doses of secondary fluid into a primary fluid stream, in operative combination comprising:

housing means having primary fluid inlet and outlet;

stepped piston means having a large face and a smaller face, mounted for reciprocation in said housing and separating the interior into at least first and second variable chamber, the housing including bleeder means in communication with the second variable chamber for releasing trapped air from the housing to facilitate start-up of the motor;

said stepped piston faces being spaced apart, said faces each having at least one opening for fluid closeable by a valve member of a valve means;

operatively connected valve means carried by said stepped piston means, being shiftable for establishing a stroke cycle of said piston by alternately closing one face of the piston and at the same time opening the other of said piston faces to pressurized fluid, said operatively connected valve means being further defined as at least one valve member of a first set operable to close said at least one opening of the large face of the piston and at least one valve member of a second set operable to close said at least one opening of the smaller face of the piston, said valve members being mounted on a shiftable connector member;

actuator rod means fixed to the housing, extending axially centrally into the piston and cooperable with an operator means for shifting the operatively connected valve means;

operator means operated by the piston and actuator rod means, for alternately shifting said operatively connected valve means at the top and bottom of the operating cycle of the stepped piston whereby pressurized primary fluid alternately operates on the large and smaller faces of the stepped piston to reciprocate said piston when pressurized fluid is supplied to the inlet of the motor housing.

4. The fluid motor of claim 3 wherein the bleeder means comprises a manually loosenable wing nut on the housing which secures one end of the actuator rod thereto.

5. A compression spring fluid motor for reciprocating a fluid injection pump to inject predetermined quantities of secondary fluid into a primary fluid stream, comprising:

a housing having axially arranged internal cylinder walls for slidingly engaging the different diameters of a stepped piston having a large diameter face and a smaller diameter face;

a stepped piston body in the housing opposed large and smaller diameter step faces with at least one fluid opening in each face communicating through the piston body;

an inlet passage in said housing for conducting primary fluid under pressure from an inlet to one of the step faces of the piston;

an outlet passage in said housing for conducting primary fluid under pressure from the other one of the step faces of the piston to an outlet in the housing;

a shiftable connector member carried coaxially by the stepped piston, said connector member having at least a pair of slotted portions intermediate said collars for receiving a sliding portion of said operating means which slides on said actuator rod means during reciprocation of the piston;

a center-hanging actuator rod means fixed to the housing and disposed axially within the connector member;

opposed valve means supported by the connector member for closing said at least one fluid opening in one face of the stepped piston while opening said at least one fluid opening in the other said face;

positioning means for alternately biasing the connector member to a closing position of one of said valve means in one stepped piston face while opening the other said valve means in the opposed piston face; and over center operator means cooperating with the actuator rod means to periodically move the connector member alternately relative to the stepped piston to overcome the biasing force of the positioning means and by operation of the valve means establish the reciprocating stroke of the piston.

6. The fluid motor of claim 5 wherein the portion of the operating means which slides on said activator rod is a block member which extends oppositely from said slotted portions of the connector member, having pivotal connections for compression spring drivers connected internally of the piston for pivotal movement.

7. The fluid motor of claim 6 wherein shock absorbing means is interposed on either side of said block cooperating with said slots to reduce operating noise and prolong life.

8. The fluid motor of claim 7 wherein the stroke cycle is determined by the distance between the stops on the actuator rod.

9. The fluid motor of claim 1 wherein the over-center operator means comprises a block member which extends oppositely from slotted portions of the connector member, the block member having pivotal connections for compression spring drivers pivotably connected to the internal wall of the stepped piston, the block member being slidably mounted between the stops on the actuator rod.

10. The fluid motor of claim 9 wherein the compression spring drivers of the operating means are oppositely pivoted on an internal wall of the piston at one end and pivoted at the pivotal connections of said block at the other and thereof, the compression spring drivers being angled from the central axis for compressive loading initiated by stops on the actuator rod and movement of the piston, to produce an over center action wherein the block suddenly shifts in said slots to shift the connector member alternately to an open position of one set of the opposed valve means and a closed position of the other set of opposed valve means at each end of the piston cycle.

11. A compression spring fluid motor for reciprocating a fluid injection pump to inject predetermined doses of secondary fluid into a primary fluid stream, in operative combination comprising:

housing means having primary fluid inlet and outlet;

stepped piston means having a large face and a smaller face, mounted for reciprocation in said housing separating the interior into at least first and second variable chambers;

operatively connected valve means carried by said stepped piston means, being shiftable for establishing a stroke cycle of said piston by alternately closing one face of the piston and at the same time opening the other of said piston faces to pressurized fluid, including shiftable positioning means for biasing the operatively connected valve means toward a closed position of one said piston faces an an open position of the other of said piston faces, the positioning means being shiftable with the valve means by an operator means;

actuator rod means fixed to the housing, extending axially centrally into the piston and cooperable with an operator means for shifting the operatively connected valve means;

operator means operated by the piston and actuator rod means, for alternately shifting said operatively connected valve means at the top and bottom of the operating cycle of the stepped piston whereby pressurized primary fluid alternately operates on the large and smaller faces of the stepped piston to reciprocate said piston when pressurized fluid is supplied to the inlet of the motor housing.

12. The fluid motor of claim 11 wherein said stepped piston faces are spaced apart, said faces each having at least one opening for fluid closable by a valve member of said valve means.

13. The fluid motor of claim 12 wherein said operatively connected valve means is further defined as at least one valve member of a first set operable to close said at least one opening of the large face of the piston and at least one valve member of a second set operable to close said at least one opening of the smaller face of the piston, said valve members being mounted on a shiftable connector member.

14. The fluid motor of claim 13 wherein the actuator rod means is sealingly and slidably mounted by a connector to the housing, having means for holding it in a fixed position for operation that is releasable to allow the actuator rod to slide longitudinally with respect to the housing in the unfixed position, the piston being movable by pressurized fluid with the actuator in the unfixed position until the shiftable connector member is partially shifted by contact with the housing, wherein the valve means is partially open forming a flow passage through both pressure faces of the piston so that pressurized primary fluid from the inlet passes through the piston, to the outlet without causing reciprocation of the piston.

15. The fluid motor of claim 14 further including a reciprocable secondary fluid injection pump connected to the housing, said pump being operated by a rod means passing from the stepped piston into said pump, said pump being supplied with secondary fluid for injection via a passage into the primary fluid stream connected to the housing.

16. The fluid motor of claim 15 wherein the rod means for operating said secondary fluid injection pump is centrally axially aligned with said stepped piston.

17. A compression spring fluid motor for reciprocating a fluid injection pump to inject predetermined doses of secondary fluid into a primary fluid stream, in operative combination comprising:

housing means having primary fluid inlet and outlet;

stepped piston means having a large face and a smaller face, mounted for reciprocation in said housing and separating the interior into at least first and second variable chambers, said stepped piston faces being spaced apart, said faces each having at least one opening for fluid closeable by a valve member of a valve means;

operatively connected valve means carried by said stepped piston means, being shiftable for establishing a stroke cycle of said piston by alternately closing one face of the piston and at the same time opening the other of said piston faces to pressurized fluid; said operatively connected valve means being further defined as at least one valve member of a first set operable to close said at least one opening of the large face of the piston and at least one valve member of a second set operable to close said at least one opening of the smaller face of the piston, said valve members being mounted on a shiftable connector member;

actuator rod means fixed to the housing, extending axially centrally into the piston and cooperable with an operator means for shifting the operatively connected valve means;

said shiftable connector member being mounted axially surrounding a portion of said fixed actuator rod, and extending centrally within the stepped piston, being axially shiftable with respect to said piston to seat any said valve members of said first or said second sets, said connector member having spaced apart upper and lower collar members for carrying respectively said first and second set of said valve members which are shiftable therewith, said connector member having at least a pair of slotted portions intermediate said collars for receiving a sliding portion of said operating means which slides on said actuator rod means during reciprocation of the piston; and operator means operated by the piston and actuator rod means, for alternately shifting said operatively connected valve means at the top and bottom of the operating cycle of the stepped piston whereby pressurized primary fluid alternately operates on the large and smaller faces of the stepped piston to reciprocate said piston when pressurized fluid is supplied to the inlet of the motor housing.

18. The fluid motor of claim 17 wherein shock absorbing means is interposed on either side of said block cooperating with said slots to reduce operating noise and prolong life.

19. The fluid motor of claim 17 wherein the portion of the operating means which slides on said activator rod is a block member which extends oppositely from said activator rod is a block connector member, having pivotal connections for compression spring drivers connected internally of the piston for pivotal movement.

20. The fluid motor of claim 19 wherein the compression spring drivers of the operating means are oppositely pivoted on an internal wall of the piston at one end and pivoted at the pivotal connections of said block at the other end thereof, the compression spring drivers being angled from the central axis for compressive loading initiated by stops on the actuator rod and movement of the piston, to produce an over center action wherein the block suddenly shifts in said slots to shift the connector member alternately to an open position of one set of valve members and a closed position of the other set of valve members at each end of the piston cycle.

21. The fluid motor of claim 20 wherein the stroke cycle is determined by the distance between the stops on the actuator rod.

22. A compression spring fluid motor for installation in a primary fluid line for reciprocating a fluid injection pump to inject predetermined doses of secondary fluid into the primary fluid stream, in operative combination comprising:

housing means having primary fluid inlet and outlet;

stepped piston means having a large face and a smaller face, mounted for reciprocation in said housing and separating the interior of the housing into at least first and second variable chambers;

operatively connected valve means carried by said stepped piston means and shiftable connector means, being shiftable for establishing a stroke cycle of said piston by alternately closing one face of the piston and at the same time opening the other of said piston faces to pressurized primary fluid;

actuator rod means fixed to the housing, extending axially centrally into the piston and cooperable with the shiftable connector means and with an operator means for shifting the operatively connected valve means, at least one of the actuator rod means and the shiftable connector means being unsealed with respect to a face of said piston;

operator means operated by the piston and actuator rod means for alternatively shifting said operatively connected valve means at the top and bottom of the operating cycle of the stepped piston whereby pressurized primary fluid alternately operates on the large and smaller faces of the stepped piston to reciprocate said piston in response to primary fluid flow when pressurized fluid is supplied to the inlet of the motor housing.

23. The fluid motor of claim 22 wherein shock absorbing means is interposed between said actuator rod means and said operator means to absorb shock upon shifting of the valve means to reduce operating noise and prolong life.

24. The fluid motor of claim 22 wherein the combination further includes shiftable positioning means for biasing the operatively connected valve means toward a closed position of one of said piston faces and an open position of the other of said piston faces, the positioning means being shiftable with the valve means by the operator means.

25. The fluid motor of claim 24 wherein the smaller face of the piston defines said first variable chamber, the larger face of the piston defines said second variable chamber, the piston providing a flow path for primary fluid passing from the the first variable chamber to the second variable chamber in one position of the valve means.

26. The fluid motor of claim 25 wherein the housing has an outlet passage forming a fluid chamber leading to said outlet, the outlet passage being separated from the second variable chamber by the larger piston face and fluidly communicating therewith in said one position of the valve means without also communicating with said first variable chamber.

27. The fluid motor of claim 22 wherein said stepped piston faces are spaced apart, said faces each having at least one opening for fluid closeable by a valve member of said valve means.

28. The fluid motor of claim 27 wherein said operatively connected valve means is further defined as at least one valve member of a first set operable to close said at least one opening of the large face of the piston and at least one valve member of a second set operable to close said at least one opening of the smaller face of the piston, said valve members being mounted on a shiftable connector member.

29. The fluid motor of claim 28 wherein said shiftable connector member is mounted axially surrounding a portion of said fixed actuator rod, and extending centrally within the stepped piston, being axially shiftable with respect to said piston to seat any said valve members of said first or said second sets.

30. The fluid motor of claim 29 wherein said connector member has spaced apart upper and lower collar members for carrying respectively said first and second set of said valve members which are shiftable therewith.

31. The fluid motor of claim 30 further including positioning means connected between the piston and the upper collar member for biasing the connector member toward opposite shifted positions wherein one of said sets of valve members tends to remain open while the other of said sets of valve members tends to remain closed.

32. The fluid motor of claim 31 further including a reciprocable secondary fluid injection pump connected to the housing, said pump being operated by a rod means passing from the stepped piston into said pump, said pump being supplied with secondary fluid for injection via a passage into the primary fluid stream connected to the housing.

33. The combination of claim 32 wherein the rod means for operating said secondary fluid injection pump is centrally axially aligned with said stepped piston.

* * * * *

UNITED STATES PATENT AND TRADEMARK OFFICE

CERTIFICATE OF CORRECTION

PATENT NO. : 5,137,435

DATED : August 11, 1992

INVENTOR(S) : Frank Walton

It is certified that error appears in the above-identified patent and that said Letters Patent is hereby corrected as shown below:

In column 14, line 43, add --having-- after "housing".

In column 15, line 34, delete "and" and add --end--.

In column 17, line 34, delete "activator rod is a block" and add --slotted portions of the--.

Signed and Sealed this

Fifth Day of October, 1993

Bruce Lehman

*Attest:*

BRUCE LEHMAN

*Attesting Officer*

*Commissioner of Patents and Trademarks*